US006534123B1

(12) United States Patent
Mukherjee et al.

(10) Patent No.: US 6,534,123 B1
(45) **Date of Patent: *Mar. 18, 2003**

(54) RECORDING MATERIAL FOR INK JET PRINTING AND METHOD FOR MAKING THE SAME

(75) Inventors: Debabrata Mukherjee, Pulaski, NY (US); Clifford M. Kaufman, Ridgewood, NJ (US)

(73) Assignee: Schoeller Technical Papers, Inc., Pulaski, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 306 days.

(21) Appl. No.: 08/872,927

(22) Filed: Jun. 11, 1997

(30) Foreign Application Priority Data

Jun. 12, 1996 (DE) ..... 196 23 432

(51) Int. Cl.[7] ..... B05D 5/04

(52) U.S. Cl. ..... 427/245; 427/246; 427/336; 427/373

(58) Field of Search ..... 428/195, 201, 428/206, 304.4, 315.5, 315.7, 315.9, 316.6, 317.9, 332, 335, 411.1, 537.5; 427/245, 246, 336, 373, 384, 385.5, 391, 393.5, 395, 412, 412.1, 415

(56) References Cited

U.S. PATENT DOCUMENTS

| | | | | | |
|---|---|---|---|---|---|
| 3,920,875 | A | * | 11/1975 | Suzuki et al. | 427/245 |
| 4,542,059 | A | * | 9/1985 | Toganoh et al. | 428/141 |
| 4,642,247 | A | * | 2/1987 | Mouri et al. | 427/214 |
| 4,894,157 | A | * | 1/1990 | Johnson | 210/490 |
| 4,954,395 | A | | 9/1990 | Hasegawa et al. | 428/318.4 |
| 5,002,825 | A | * | 3/1991 | Mimura et al. | 428/315.5 |
| 5,108,607 | A | * | 4/1992 | Kraus et al. | 210/500.39 |
| 5,264,275 | A | * | 11/1993 | Misuda et al. | 428/304.4 |
| 5,374,475 | A | * | 12/1994 | Wälchli | 428/304.4 |
| 5,605,750 | A | * | 2/1997 | Romano et al. | 428/304.4 |
| 5,653,882 | A | * | 8/1997 | Moss et al. | 210/490 |
| 5,707,722 | A | * | 1/1998 | Iqbal et al. | 428/304.4 |
| 5,759,639 | A | | 6/1998 | Kloos | 427/542 |

FOREIGN PATENT DOCUMENTS

EP 0409440 A1 1/1991

OTHER PUBLICATIONS

Patent Abstracts of Japan, M–495, Jul. 4, 1986, Vo. 10, No. 191, 61–35275, Okura, Feb. 1986.

* cited by examiner

*Primary Examiner*—Marie Yamnitzky
(74) *Attorney, Agent, or Firm*—Pillsbury Winthrop LLP

(57) ABSTRACT

A recording material suitable for ink jet printing, and a method for making the same. The recording material includes a dye-receiving layer, a support layer, and one or more microporous membrane layers. The microporous membrane layer(s) can be interposed between the dye-receiving layer and the support layer, and/or can be disposed on a side of the dye-receiving layer opposing the support layer. The microporous membrane layer preferably has pores with, on average, a pore size in a range of from about 0.01 $\mu$m to about 10 $\mu$m, and more preferably in a range of from about 0.1 $\mu$m to about 1 $\mu$m.

6 Claims, 1 Drawing Sheet

RECORDING MATERIAL FOR INK JET PRINTING AND METHOD FOR MAKING THE SAME

BACKGROUND OF THE INVENTION

1. Field of the Invention

The invention relates to a recording material, and in particular to a recording material suitable for use in ink jet printing applications.

2. Description of the Related Art

Ink jet printing techniques typically involve the application of droplets of a recording fluid (for example, ink) to the surface of the recording material. The ink usually includes at least a colorant and an ink fluid.

There are fundamentally two variant methods for droplet generation and application. The first method is a continuous process in which an ink jet is expelled from a discharge nozzle and, due to surface tension, breaks apart into microscopically small droplets. The droplets are electrically charged and placed on the underlay or diverted to a reservoir by downstream diversion plates that are controlled by the digital signals. In the second method, or the so-called "drop-on-demand" method, the image signal trips a mechanical pulse that expels the droplet. The earliest "drop-on-demand" printers employed the piezoelectric effect to bring about the expulsion of the droplets. Today, this "drop-on-demand" method has been largely replaced by the thermal ink jet, also known as the bubble jet. In accordance with the thermal ink jet method, the image signal activates a heating element, which creates a vapor bubble in the aqueous ink. The resultant vapor pressure expels the droplet.

Commercial demands and expectations have placed stringent performance requirements on the ink jet image-receiving (i.e., recording) materials. For example, the recording materials are expected to be capable of producing an ink-jet-printed image having high resolution, high color density, good resistance to smearing (smearfastness), good waterproofness, and good rub resistance (i.e., resistance to being rubbed off when wetted).

To achieve these and other expectations, the following fundamental conditions should be met by the recording material:

- quick absorption of the ink by the recording material (short drying times);
- accurate spreading of the sprayed-on ink droplets (e.g., in circles) to ensure precise demarcations;
- controlled ink diffusion in the recording material, such that the diameter of the dots of ink is not enlarged more than absolutely necessary;
- excellent ability to overlap an ink dot on a previously-applied ink dot without impairing or wiping away the previously-applied ink drop;
- high visual reflection density and high brilliance of the colors exhibited by the surface of the recording material; and
- high dimensional stability of the recording material, without stretching after printing.

The provision of a recording material that satisfies each of these demands is difficult, especially since these demands conflict with one another to some extent. For instance, overly rapid attainment of a smearproof state means that an ink droplet will spread only a little, if at all, which impairs the clarity of the resultant image.

The difficulties involved with satisfying the above-mentioned demands are compounded by recent improvements in the performance—such as higher recording speeds—of ink jet recording equipment.

Conventional ink jet recording materials contain a support and ink absorbing layers. The support can be made of polyester resin or diacetate film or paper or other substrates, such as woven or non-woven layers.

The ink absorbing layers are porous and comprise hydrophilic pigments and water soluble polymeric binders, such as gelatin, starch, pectin, casein, carboxymethyl cellulose, or polyvinyl alcohol. Pigments and binders serve to increase the whiteness of the material and to retain dye from the ink at the surface of the sheet. A high image resolution may be achieved with said absorbing layers; however, the difficulty in achieving a high gloss is a significant problem with these papers.

To achieve a high gloss (>70% at 60°) in recording papers, it has been proposed to first extrusion-coat the base paper with water-insoluble polymers, such as polyethylene, and then provide the base paper with a receiving layer. However, this proposed method makes for poor drying times.

In order to achieve faster drying times, it has been proposed to modify the ink absorbing layer of conventional recording materials to allow ink fluid to pass therethrough by capillary flow and hence quickly. Such a flow is faster by orders of magnitude than a flow by diffusion only and therefore causes rapid drying out of the ink fluid on the dye-receiving layer. In this regard, according to Hagen-Poiseuille's Law, the quantity of liquid per unit of time that passes through an arrangement of pores is proportional to the fourth power of the mean diameter of the pores. Therefore, most of the flow of liquid passes through pores having large radii. The achievement of sufficiently fast drying times in conventional recording materials generally requires layers having a pore diameter distribution in which the mean value is shifted to relatively large pores, e.g., 10 $\mu$m to 30 $\mu$m. However, such large pore diameter distributions result in a lessening in the desired gloss of the recording material. Not until a mean pore size on the order of magnitude of 0.1 to 1 $\mu$m is attained is a high gloss for the dye-receiving layer achieved.

A long-felt need therefore has existed to provide a recording material that simultaneously exhibits high gloss and has a high drying speed with respect to the ink fluid, as well as exhibits good color density and resolution.

SUMMARY OF THE INVENTION

It is, therefore, an objective of the present invention to solve the aforementioned problems associated with the related art as well as to address the need expressed above.

It is another objective of the present invention to provide a recording paper having high gloss and high drying speed.

In accordance with the principles of the present invention, these objectives are obtained by providing a recording material comprising: (a) at least one dye-receiving layer having opposing first and second surfaces; (b) at least one support layer having opposing first and second surfaces, the first surface of the support layer facing the second surface (backside) of the dye-receiving layer; and (c) at least one member selected from the group consisting of (i) at least one microporous membrane layer interposed between the dye-receiving layer and the support layer and/or (ii) at least one microporous membrane layer having an inner surface facing the first surface of the dye-receiving layer.

These and other objects, features, and advantages of the present invention will become apparent from the following detailed description when taken in conjunction with the accompanying drawings which illustrate, by way of example, the principles of the present invention.

BRIEF DESCRIPTION OF THE DRAWING

The accompanying drawings illustrate the present invention. In such drawings.

DESCRIPTION OF THE PREFERRED EMBODIMENTS

Figure 1:
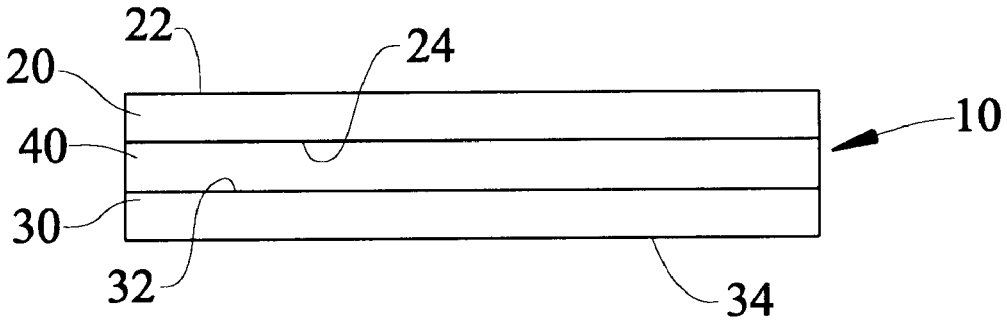
FIG. 1 is an elevational view of a recording material in accordance with a first embodiment of the present invention.

Referring now more particularly to the drawings, there is shown in FIG. 1 a recording material, generally designated by reference numeral 10, suitable for ink jet printing. The recording material 10 includes a dye-receiving layer 20 having a first surface 22 and an opposing second surface (backside) 24. The recording material 10 further includes a support layer 30 having a first surface 32 and an opposing second surface 34, with the first surface 32 facing the second surface 24 of the dye-receiving layer 20. Although only one dye-receiving layer 20 and one support layer 30 are illustrated in FIG. 1, it is understood that the recording material 10 can include a plurality of dye-receiving layers 20 and/or a plurality of support layers 30, and that the dye-receiving layers 20 and support layers 30 can be arranged with respect to each other in various manners.

As illustrated in FIG. 1, interposed between the dye-receiving layer 20 and the support layer 30 is a microporous membrane layer 40. It is again understood, although not illustrated, that the recording material 10 can include a plurality of microporous membrane layers 40.

In operation, the dye-receiving layer 20 receives the ink and passes the ink fluid through layer 20, leaving the dye behind that extends across the thickness of the dye-receiving layer 20. The support layer 30 is preferably selected as a material that is capable of absorbing the excess ink fluid.

Figure 2:
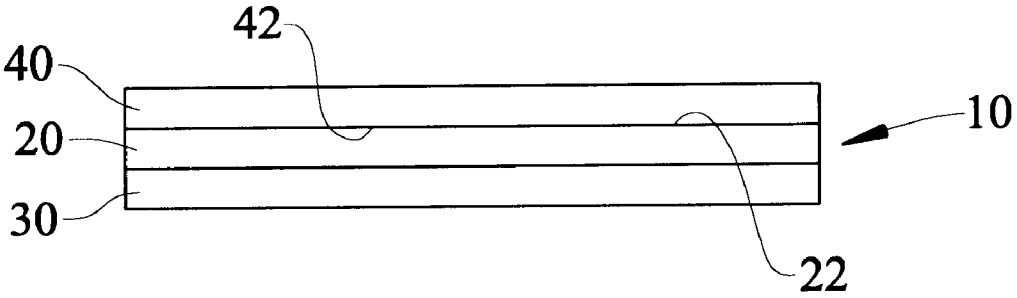
FIG. 2 is an elevational view of a recording material in accordance with a second embodiment of the present invention.

The microporous membrane layer 40 does not necessarily have to be interposed between the dye-receiving layer 20 and the support layer 30. For instance, as illustrated in FIG. 2, the microporous membrane layer 40 can be positioned such that its inner surface 42 faces the first surface 22 of the dye-receiving layer 20. Again, the recording material 10 shown in FIG. 2 can include a plurality of dye-receiving layers 20, support layers 30, and/or microporous membrane layers 40.

Figure 3:
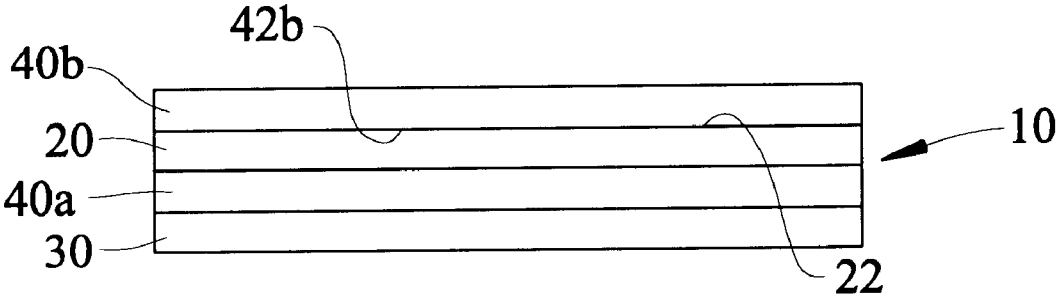
FIG. 3 is an elevational view of a recording material in accordance with a third embodiment of the present invention.

In accordance with still another embodiment of the present invention, and as illustrated in FIG. 3, the recording material 10 can include a first microporous membrane layer 40*a* interposed between the dye-receiving layer 20 and the support layer 30, and a second microporous membrane layer 40*b* positioned such that its inner surface 42*b* faces the first surface 22 of the dye-receiving layer 20. Again, the recording material 10 shown in FIG. 3 can include a plurality of dye-receiving layers 20, support layers 30, first microporous membrane layers 40*a* and/or second microporous membrane layers 40*b*.

Preferably, in order to achieve one of the aforementioned objectives and attain a high gloss, the microporous membrane layer 40 contains pores having, on average, a capillary diameter in a range of from about 0.001 $\mu$m to about 100 $\mu$m, and more preferably in a range of from about 0.01 $\mu$m to about 10 $\mu$m, and still more preferably in a range of from about 0.1 $\mu$m to about 1 $\mu$m.

It is noted that the recording material 10 of the present invention can optionally comprise auxiliary layers as well. Auxiliary layers can include, for example, antistatic and non-curling layers, which can be positioned, for example, on the backside of the support layer 30, and primer or adhesive layers, which can be positioned, for example, on the back or frontside of the support layer 30 or between support layers.

The dye-receiving layer 20 can contain, for instance, binders, dye-fixing cationic compounds, pigments, fillers, and other auxiliary agents, such as dispersion promoters, hardeners, defoamants, or pH adjusters. It is noted that if a plurality of dye-receiving layers is provided in the recording material 10, each dye-receiving layer can have a composition and be prepared in a manner independent of the other dye-receiving layers.

Suitable binders for the dye-receiving layer 20 include, by way of example and without limitation, natural or synthetic polymers, including the following: water-soluble polymers such as gelatin, polyvinyl alcohol, polyacrylamide, sodium alginate, polyvinyl pyrrolidone, casein, starch, sodium polyacrylate, the like, and any combination thereof; polymers soluble in organic solvents, such as polyvinyl butyral, polyvinyl chloride, polyvinyl acetate, polyacrylonitrile, polymethyl methacrylate, melamine resin, polyurethane, the like, and any combination thereof; pectin; carboxymethyl cellulose; and combinations thereof.

Suitable pigments and fillers for the dye-receiving layer include, by way of example and without limitation, silicic acid, talcum, kaolin, calcium carbonate ($CaCO_3$), aluminum silicate, aluminum oxide ($Al_2O_3$), zeolite, titanium dioxide ($TiO_2$), the like, and any combination thereof. The pigments can serve not only to increase the degree of whiteness (or other color) of the material, but also to retain the dyes from the recording fluid at the surface of the sheet.

Suitable cationic dye fixing compounds, which can be used to fix the ink dyes, include, for example and without limitation, quaternary ammonium polymers, such as quaternary polyhydroxyammonium salt, quaternary polyammonium methacrylate salt, and/or polydiallyl dimethylammonium salt.

As the support, a polyester resin or diacetate film or paper may for instance be used. Also suitable are coated base paper and woven and non-woven substrates.

A method of making the printing material of the present invention is discussed below. It is understood that the printing material of the present invention is not limited to the following production method.

The dye-receiving layer is first prepared by applying an aqueous coating composition to a support and drying the composition. The coating composition can be applied to the support by any conventional application or metering process, such as for example and without limitation, a roll coating application, die-, cascade-, or curtain coating, gravure coating or cast coating, and airbrushes or blade knife metering. The amount of coating composition applied on the substrate layer can, for example, be in a range of from about 0.1 g/m$^2$ to about 20 g/m$^2$, and preferably is in a range of from about 1 g/m$^2$ to about 14 g/m$^2$.

The membrane layer can be formed, for instance, on one of the aforementioned layers from a casting solution (also referred to herein as a polymer solution) of a hydrophobic or hydrophilic polymer in a suitable solvent. The membrane layer formation process can comprise, but is not limited to, the practice of the following steps:

1. applying at least one polymer solution on the support and/or on the dye-receiving layer;
2. evaporating the majority of the solvent from the polymer solution;
3. gelling of the polymer;
4. subjecting the gelled polymer to capillary development and immobilization; and
5. evaporating the remainder of the solvent.

The membrane layer can comprise, for instance, one or more polymers selected from the group consisting of polyether sulfones, polysulfones, cellulose acetate, polypropylene, polyamide, polyvinylidene fluoride, cellulose esters, polycarbonates, PTFE, polyvinyl chloride, acrylic polymers, and the like. Membrane layers from these polymers can be prepared, for instance, by phase inversion or by evaporating off a solvent.

Suitable solvents for the casting solution include, by way of example and without limitation, N-methylpyrrolidone, dimethylformamide, dimethylacetamide, chloroform, butanol, dimethylsulfoxide, propylene carbonate, tetrahydrofuran, the like, and any combination thereof.

Pore formers in the form of LiCl or $LiNO_3$ and organic substances (such as polyvinyl pyrrolidone) and/or swelling agents (also known as thickening agents) can be added to the casting solutions. Suitable swelling agents include, without limitation alginates, pectins, starches, dexatrine, carboxymethylcellulose, zeolites, polycarboxylic acids. Pigments (such as $TiO_2$) and/or fillers can also be used. Before the solvent is completely evaporated, the structure of the membrane is fixed (coagulation), for instance by dipping the sol film into a precipitating agent, such as water, which permits the sol to coagulate to a gel, thereby fixing it. This process can be improved, e.g., accelerated, by introducing suitable cross-linking agents which serve to crosslink the polymeric binder, or by subjecting the casting solution to gamma irradiation. Suitable cross-linking agents include, by way of example and without limitation, aldehydes, polyamides, and polyisocyanates.

The casting solution can be applied to the support by means of nozzles, a slot die, blades, or coating knives.

The application weight of the membrane layer can, for example, be in a range of from about 0.1 g/m$^2$ to about 75 g/m$^2$, and preferably is in a range of from about 0.5 g/m$^2$ to about 50 g/m$^2$.

By using the membrane layer in the recording material, the thickness of the dye-receiving layer can be decreased, on the assumption that in that case the ink fluid can migrate more quickly through the dye-receiving layer having a lesser thickness, even if the dye-receiving layer has a small mean pore diameter selected for achieving a high gloss. After migrating through the dye-receiving layer, the ink fluid passes semipermeably through the membrane layer and is absorbed by the support layer. Since the membrane layer is permeable to the ink fluid only in the direction of the support layer, short flow through times and hence short drying times of the dye-receiving layer can be attained. The ink fluid does not flow back into the dye-receiving layer, due to the selective direction of admission of the membrane layer. A general discussion concerning diffusion through porous membrane can be found in Kirk-Othmer, Encyclopedia of Chemical Technology (1981), the complete disclosure of which is incorporated herein by reference.

By way of example, a plastic film or an uncoated or coated base paper with a weight per unit of surface area of about 50 g/m$^2$ to about 250 g/m$^2$ can be used as the support layer for the recording material of the present invention. Suitable plastics include, by way of example and without limitation, polyesters and polyolefins, which are preferably employed where the base paper is to be coated with plastic. The base paper can also be coated with an aqueous solution of, for example, barium sulfate, or can be coated with a dispersion of an acrylate polymer.

The back side of the recording material can also have a functional auxiliary layer, such as an anticurling or antistatic layer, for which the application quantity can range from about 0.1 g/m$^2$ to about 25 g/m$^2$.

A membrane layer can optionally be used as a dye-receiving layer. By suitable modification of the surface of the membrane, and in particular by rendering it hydrophilic, high resolution and good dye graduation can be attained.

In a further feature of the invention, the membrane layer can also be disposed as the topmost microporous membrane layer, such that the microporous membrane is disposed on the exterior surface of the dye-receiving layer.

The membrane layer can form a transparent or opaque top layer, while simultaneously serving as a transport layer for the ink, while the dye-receiving layer serves as a fixing layer for the dye. The thickness of the membrane layer can be in a range of from about 0.1 $\mu$m to about 75 $\mu$m, is preferably in a range of from about 0.5 $\mu$m to about 50 $\mu$m, and more preferably is in a range of from about 0.5 $\mu$m to about 5 $\mu$m, for a dye-receiving layer having thickness in a range of from about 0.1 $\mu$m to about 20 $\mu$m. The thickness of the carrier layer can be, for example and without limitation, in a range of from about 50 $\mu$m to about 350 $\mu$m.

EXAMPLES

The following non-limiting examples serve to explain embodiments of the present invention in more detail.

Example 1

The front side of a neutrally sized raw paper with a basis weight of 100 g/m$^2$ was coated at room temperature with a casting solution of cellulose acetate (25 wt. %), acetone (45 wt. %) and formamide (30 wt. %). After casting the solution and evaporating the solvent for about 25 seconds, the layer was gelled by immersion in water. Next, the coated paper was dried to remove the remainder of the solvent. The application weight of the resultant membrane layer was 15 g/m$^2$.

In a further operation, the paper provided with the membrane layer was coated with an aqueous coating composition to create a dye-receiving layer. The dye-receiving layer had a composition as follows:

| | |
|---|---|
| 31.6 wt. % | Polyvinyl alcohol (degree of saponification: 98 mol %) |
| 31.6 wt. % | Polyvinyl pyrrolidone (molar weight: 630,000 Daltons) |
| 31.6 wt. % | Vinyl acetate/butylacrylate copolymer |
| 5.2 wt. % | Quaternary polyammonium salt |

The application weight of the receiving layer was 10 g/m$^2$. The quantities stated above in wt. % refer to the dried layer.

The recording paper obtained was imprinted by the so-called thermal jet printing and analyzed. The test results are summarized in Table 1.

Example 2

The back side of the recording paper of Example 1 was additionally coated with an anticurling layer by preparing an aqueous gelatin solution with a gelatin content of 7 wt. %, which was mixed with 0.5 wt. % saponin and 0.6 wt. % of a hardener combination of 1,3,5-triacryloyl-hexahydro-s-triazene and formaldehyde in a weight ratio of 1:0.2. The gelatin solution was poured in a known manner onto the back side of the recording paper in such a quantity that after the usual solidification and ensuing drying, the anticurling layer, which had an application weight of 5 g/m$^2$, was obtained.

The recording paper, comprising the anticurling layer, paper support, membrane layer and dye-receiving layer, was imprinted as in Example 1 and analyzed for its properties, which are reported in Table 1.

Example 3

The front side of a neutrally sized raw paper with a basis weight of 120 g/m$^2$ was coated with the following receiving layer:

| | |
|---|---|
| 41.0 wt. % | Polyvinyl alcohol (degree of saponification: 98 mol %) |
| 41.0 wt. % | Polyvinyl pyrrolidone (molar weight: 630,000 Daltons) |
| 15.0 wt. % | Aminomethyl methacrylate |
| 3.0 wt. % | Quaternary polyammonium salt |

The application weight of the receiving layer was 9 g/m$^2$. The above-mentioned quantities are given in wt. % and refer to the dried layer.

The paper provided with the receiving layer was coated in a further operation with a casting solution of polyamide (10 weight %) dimethylacetamide (85 weight %) and $TiO_2$ (5 weight %). After partial evaporation of the solvent, coagulation was performed in water. The application weight of the membrane layer was 1 g/m$^2$. The properties of this material are reported in Table 1.

Example 4

Onto the front side of a base paper with a basis weight of 80 g/m$^2$, a casting solution of sodium polysulfone (40 wt. %), dimethyl formamide (48 wt. %) and chloroform (12 wt. %) was poured to form a sol film 50 $\mu$m in thickness. The evaporation time was 3 min, and the coagulation step followed. After thermal treatment, a dye-receiving layer prepared in accordance with Example 3 was applied to the membrane layer.

Comparison Example 1

The front side of a neutrally sized raw paper with a basis weight of 100 g/m$^2$ was coated with the following receiving layers:

| | V1a | V1b |
|---|---|---|
| Polyvinyl alcohol | 41.0 wt. % | 36.0 wt. % |
| Polyvinyl pyrrolidone | 41.0 wt. % | 36.0 wt. % |
| Aminomethyl methacrylate | 15.0 wt. % | 5.0 wt. % |

-continued

| | V1a | V1b |
|---|---|---|
| Quaternary polyammonium salt | 3.0 wt. % | 3.0 wt. % |
| Colloidal silica | — | 20.0 wt. % |

Comparison Example 2

The front side of a raw paper with a basis weight of 100 g/m$^2$ was coated with LDPE (low-density polyethylene) in an application quantity of 20 g/m$^2$, and the back side was coated with a mixture of LDPE and HDPE (high-density polyethylene) in an application quantity of 20 g/m$^2$. A receiving layer in accordance with example 1 was applied in an amount of 10 g/m$^2$ to the polyethylene-coated paper.

The recording material obtained was improved as in Example 1 and analyzed for its properties.

The recording materials obtained in accordance with the Examples and Comparison Examples were tested by imprinting the recording materials using an HP DeskJet 550C made by Hewlett-Packard. This ink jet printer uses the bubble jet (thermal jet) technique.

The dye density, drying time, gloss and so-called "bleed" in the printed images obtained were tested.

The density measurements were performed using the "X RITE 428" densitometer. The measurements were made for the basic colors of cyan, magenta, yellow and black at 100% saturation.

Bleeding of the inks at the edges of cohering dyed areas was graded visually with the grades of 1 to 6 (for very good to very poor).

The measurement of the gloss values was done with the laboratory reflectometer RL3 made by the company known as Dr. Bruno Lange GmbH of Berlin, Germany under DIN Standard 67530 at a measurement angle of 60°.

The drying behavior, i.e., when the ink no longer smeared, of the recording material was ascertained as follows: On a sheet of paper, a bar (i.e., an elongated rectangular field of printing) was printed with black ink (pure black), and after a waiting period of 120 seconds, 20 sheets of paper were laid on it. The dye transfer was taken as a measure of drying. The drying times were categorized as being less than 120 seconds (very good), between 120–240 seconds, or more than 240 seconds (poor).

TABLE 1

Test results

| | Color Density | | | | Drying | | Bleed |
|---|---|---|---|---|---|---|---|
| Example | cyan | magenta | yellow | black | time (s) | Gloss (%) | grade |
| 1 | 1.8 | 1.8 | 1.6 | 2.0 | <120 | 90 | 1 |
| 2 | 1.8 | 1.8 | 1.6 | 2.0 | <120 | 90 | 1 |
| 3 | 2.0 | 1.9 | 1.8 | 2.1 | <120 | 85 | 1 |
| 4 | 2.0 | 1.9 | 1.9 | 2.2 | <120 | 90 | 1 |
| V1a | 2.0 | 1.9 | 1.8 | 2.1 | 200 | 75 | 2 |
| V1B | 2.1 | 2.0 | 1.9 | 2.2 | 180 | 70 | 2 |
| V2 | 1.8 | 1.7 | 1.6 | 1.9 | <240 | 80 | 2 |

A recording material for ink jet printers and a method for making the same are disclosed in priority application 196-23-432.8, filed in Germany on Jun. 12, 1996, the complete disclosure of which is incorporated herein by reference.

It will thus be seen that the objectives and principles of this invention have been fully and effectively accomplished.

It will be realized, however, that the foregoing preferred specific embodiments have been shown and described for the purpose of this invention and are subject to change without departure from such principles. Therefore, this invention includes all variations, modifications, and improvements encompassed within the spirit and scope of the appended following claims.

What is claimed is:

1. A method of fabricating a recording material that is suitable for use with ink-jet printing and comprises at least one dye-receiving layer, a support layer, and at least one microporous membrane layer, said method comprising:

preparing a polymer solution in a solvent and treating said polymer solution via at least one technique selected from the group consisting of phase inversion and evaporation to develop and immobilize capillaries in said microporous membrane layer; and arranging the microporous membrane layer between said dye-receiving layer and said support layer, wherein said microporous membrane layer is a first microporous membrane layer, and wherein said recording material further comprises a second microporous membrane layer facing a surface of said dye-receiving layer so that said dye-receiving layer is interposed between said first and second microporous membrane layers.

2. The method of claim 1, wherein at least one microporous membrane layer has pores with, on average, a pore size in a range of from about 0.001 $\mu$m to 100 $\mu$m.

3. The method of claim 1, wherein at least one microporous membrane layer has pores with, on average, a pore size in a range of from about 0.01 $\mu$m to 10 $\mu$m.

4. The method of claim 1, wherein said polymer solution comprises at least one polymer selected from the group consisting of polyether sulfones, polysulfones, cellulose acetate, polypropylene, polyamide, polyvinylidine fluoride, cellulose esters, polycarbonates, PTFE, poly(vinyl chloride), and acrylic polymers.

5. The method of claim 1, wherein at least one microporous membrane layer has a thickness in a range of from 0.1 $\mu$m to 75 $\mu$m.

6. The method of claim 1, wherein at least one microporous membrane layer comprises at least one member selected from the group consisting of a filler and pigment.

* * * * *